US005378420A

United States Patent [19]

Harris et al.

[11] Patent Number: 5,378,420

[45] Date of Patent: Jan. 3, 1995

[54] PROCESS FOR PREPARING AROMATIC POLYIMIDE FIBERS

[75] Inventors: Frank W. Harris; Stephen Z. D. Cheng, both of Akron, Ohio

[73] Assignee: Edison Polymer Innovation Corporation, Brecksville, Ohio

[21] Appl. No.: 78,516

[22] Filed: Jun. 16, 1993

[51] Int. Cl.[6] ..... D01D 5/16; D01F 6/74; D02J 1/22

[52] U.S. Cl. ..... 264/184; 264/210.6; 264/210.8; 528/183; 528/188; 528/351; 528/353

[58] Field of Search ..... 264/184, 203, 205, 210.6, 264/210.8, 211, 211.12; 528/183, 188, 351, 353

[56] References Cited

U.S. PATENT DOCUMENTS

| | | | |
|---|---|---|---|
| 4,370,290 | 1/1983 | Makino et al. | 264/184 |
| 4,473,523 | 9/1984 | Sasaki et al. | 264/211.2 |
| 5,071,997 | 12/1991 | Harris | 528/353 |

FOREIGN PATENT DOCUMENTS

| | | |
|---|---|---|
| 3727945 | 2/1988 | Germany . |
| 1-260015 | 10/1989 | Japan . |

OTHER PUBLICATIONS

Translation of Japan 1-260,015 (Published Oct. 17, 1989).

Abstract of Japan 1-33,134 (Published Feb. 3, 1989).

Kaneda, T. et al. "High Strength-High Modulus Polyimide Fibers I. One-Step Synthesis of Spinnable Polyimides." *Journal of Applied Polymer Science,* vol. 32 (1986), pp. 3133-3149.

Kaneda, T. et al. "High Strength-High Modulus Polyimide Fibers II. Spinning and Properties of Fibers." *Journal of Applied Polymer Science,* vol. 32 (1986), pp. 3151-3176.

*Primary Examiner*—Leo B. Tentoni

*Attorney, Agent, or Firm*—Hudak & Shunk Co.

[57] ABSTRACT

A process for preparing polyimide fibers involves the preparation of a polymer in p-chlorophenol from reactants comprising 2,2'-dimethyl-4,4'-diaminobiphenyl and a tetracarboxylic anhydride. Following its preparation, the polyimide fibers can be spun directly from the reaction mixture. In a preferred embodiment, the dianhydride comprises 3,3',4,4'-biphenyltetracarboxylic dianhydride.

4 Claims, 1 Drawing Sheet

PROCESS FOR PREPARING AROMATIC POLYIMIDE FIBERS

TECHNICAL FIELD

This invention relates to polyimides having aromatic links in their molecular chains. More particularly, this invention relates to segmented, rigid-rod polyimide fibers characterized by improved physical properties. Specifically, this invention relates to aromatic polyimides and to their preparation by means of a single-step process, employing a specific solvent, in order to produce fibers that can be drawn under annealing conditions to provide high-performance filamentary products.

BACKGROUND OF THE INVENTION

Polyimides have long been recognized as materials exhibiting excellent thermal and thermo-oxidative stability, as well as providing superior mechanical and electrical properties, including good solvent resistance and light stability. These attributes are to a large measure responsible for the wide acceptance which such materials have received in the aerospace, electronics and other fields. As a consequence, polyimides have enjoyed widespread use, for example, in films, coatings, and molded products, particularly those intended for high temperature applications.

Such desirable properties have not, however, avoided certain less desirable characteristics of polyimides such as their tendency to decompose before melting and their general lack of solubility in ordinary solvents. Such short-comings have made it difficult, for instance, to process polyimide materials into fibers displaying the advantageous properties referred to.

In an attempt to overcome the described solubility and melting problems associated with the preparation of fibers, resort has often been had to the polymerization of the diamine monomers with tetracarboxylic dianhydrides in a suitable organic solvent at room temperature to yield a soluble intermediate polymer in the form of a polyamic acid. The reaction is readily accomplished in a number of suitable solvents, such as, for instance, N,N-dimethylformamide, DMF; N-methylpyrrolidine, NMP, and the like, from solutions from which the desired fibers can readily be spun. Following such step, the polyamic acid fiber is converted into the corresponding polyimide fiber by dehydration effected with heat or chemical dehydration agents.

While the two-step process detailed results in the production of the sought-after polyimide filamentary products, certain disadvantages encountered in the process are difficult to avoid. For example, the imidization reaction being reversible can lead to products having relatively low molecular weights that exhibit undesirable reactivity and mechanical weakness. Furthermore, the process often results in the creation of undesirable voids in the resulting filaments due to the water by-product formed during the reaction. High degrees of imidization are also difficult to obtain in fibers. An example of the two-step process set forth in the preceding is shown, for example, in Japanese Patent No. 1,260,015. The process there described involves the reaction of 2,2'-dimethyl-4,4'-diaminobiphenyl with pyromellitic dianhydride, PMDA, in a first step. After being spun, the fibers are imidized in a second step by thermal treatment.

Recently, however, it has been found that certain polyimides are sometimes soluble in particular solvents, and in such instances, polymers can be produced through use of a so-called one-step process in which the polyimides can be prepared in a single step. Thus, it has been found that 3,3',4,4'-biphenyltetracarboxylic dianhydride, BPDA, and pyromellitic dianhydride, PMDA, can be reacted with 3,3'-dimethyl-4,4'-diaminobiphenyl, OTOL, in a solution in which phenol, p-chlorophenol, m-cresol, p-cresol or 2,4-dichlorophenol are employed as reaction mixture solvents. The conversion to the polyimide takes place in solution, and fibers can be directly spun therefrom; "Hi-Strength-Hi-Modulus Polyimide Fibers I. One-Step Synthesis of Spinable Polyimides." Takaho Kaneda, et al.

Similarly, U.S. Pat. No. 5,071,997 teaches that segmented rigid-rod polyimides synthesized from BPDA and 2,2'-bis(trifluoromethyl)-4,4'-diaminobiphenyl, FMB, can be spun in a one-step process from hot m-cresol.

The fact that suitable solvents for such one-step methods are unpredictable, however, may be gathered from the fact that the patent referred to indicates that the polyimide there disclosed has but limited solubility in standard halogenated hydrocarbon solvents. Such unpredictability makes it difficult, therefore, to practice the one-step process other than with known systems.

One of the important reasons for the desirably high moduli of aromatic polyimides arises from the fact that the aromatic rings of the compounds are joined by rigid imide rings. Such structures provide the stiff backbones that favor formation of strong, rigid fibers. However, information relating to polyimide fibers is recognized by those familiar with the art as being limited, a lack which likely stems from the difficulty in finding materials suitable for solubilizing high molecular weight polyimides.

A further factor of significance in determining the physical properties of aromatic polyimides, however, is the presence or absence of substituent groups associated with the aromatic ring portions of the compounds. In this regard, both the nature and location of such substituents on the rings greatly influences the properties of the polyimide materials. As will be set forth more particularly in the following, the nature and position of such substituents appears to be important both to the manner of the polyimides' rates of crystallization, their degree of crystallinity, their crystalline packing as well as to their solubility in solvents, the latter being determinative of whether or not the polyimides are susceptible to fabrication by means of the preferred one-step process.

In view of the foregoing, therefore, it is a first aspect of this invention to provide polyimide fibers with improved physical properties.

A second aspect of this invention is to provide segmented, rigid-rod polyimide fibers that do not need to be spun from a polyamic acid solution.

An additional aspect of this invention is to provide polyimide polymers having specific substituent groups located in specific positions on the aromatic portions thereof.

A further aspect of this invention is to provide segmented, rigid-rod polyimide polymers which, together with the reactants required therefore, are soluble in a particular solvent.

Another aspect of this invention is to provide a reaction mixture for the synthesis of segmented, rigid-rod polyimide polymers from which polyimide fibers can be formed directly following formation of the polymers in solution.

Yet another aspect of this invention is to provide segmented, rigid-rod polymers with desirable crystallization and morphology characteristics.

A still further aspect of this invention is to provide segmented, rigid-rod fibers that exhibit crystallization rates which facilitate their drawing.

BRIEF DESCRIPTION OF THE INVENTION

The foregoing and other aspects of the invention are provided by a process for preparing a segmented, rigid-rod copolymer in which 2,2'-dimethyl-4,4'-diaminobiphenyl, DMB, and tetracarboxylic dianhydride monomers are combined with or without a catalyst to form a reaction mixture employing p-chlorophenol as a solvent. Following its preparation, the reaction mixture is heated to the polymerization temperature of the monomers and maintained in its heated condition until the desired polymer has been formed.

The foregoing and other aspects of the invention are provided by a fiber prepared from a polymer according to the preceding paragraph.

The foregoing and further aspects of the invention are provided by a composite prepared from a polymer according to the penultimate paragraph.

The foregoing and still additional aspects of the invention are provided by a process for preparing a polyimide fiber comprising polymerizing 2,2'-dimethyl-4,4'-diaminobiphenyl and a tetracarboxylic dianhydride with a catalyst in a heated liquid reaction mixture employing p-chlorophenol as a solvent. A fiber is subsequently spun directly from the reaction mixture and then drawn at a temperature of from about 400° to about 450° C.

BRIEF DESCRIPTION OF THE DRAWINGS

The invention will be better understood when reference is had to the following drawings, in which like-numbers refer to like-parts, and in which.

DETAILED DESCRIPTION OF THE INVENTION

Figure 1:
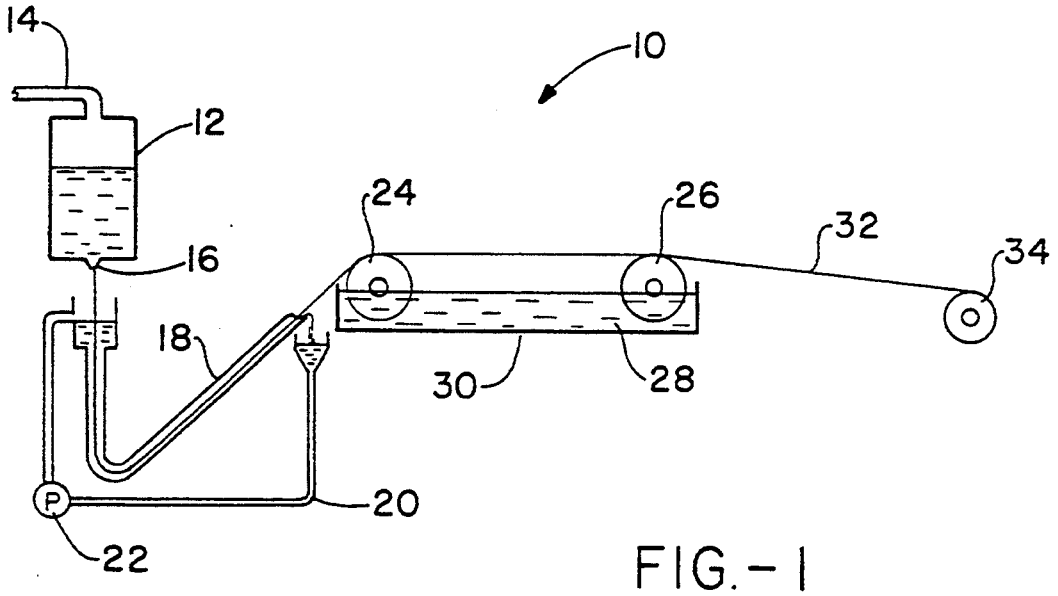
FIG. 1 is a schematic representation of a dry jet-wet spinning fiber formation process.

High-performance polymeric fibers possessing high-strength, high-modulus and high-temperature properties such as the KEVLAR® polyaramid fibers marketed by DuPont have been of interest since the late 1960s. KEVLAR® polyaramid fibers display tenacities, for example, in the range of 18–22 grams per denier, gpd, tensile moduli of 600 to 1,000 gpd, and a zero-strength temperature in the neighborhood of about 400° C.

While such polyaramid fibers represented a significant advance over their predecessors, the search for high-performance polymeric fibers having still higher strengths and moduli, and displaying even superior high-temperature properties has continued.

As is described in the following, a semi-crystalline polyimide of the segmented, rigid-rod type has now been discovered that possesses desirably high-working temperatures, excellent compressive strengths, and exceptional tenacities and moduli after being drawn.

In addition, it has been determined that the polymers from which the fibers of the invention are prepared are soluble in a particular solvent from which they may be directly spun.

The polymers from which such fibers are prepared comprise polyimides having regularly repeating sequences synthesized from 3,3',4,4'-biphenyltetracarboxylic dianhydride and 2,2'-dimethyl-4,4'-diaminobiphenyl, and variations of such reactants as disclosed hereinafter. Their reaction is shown in the following.

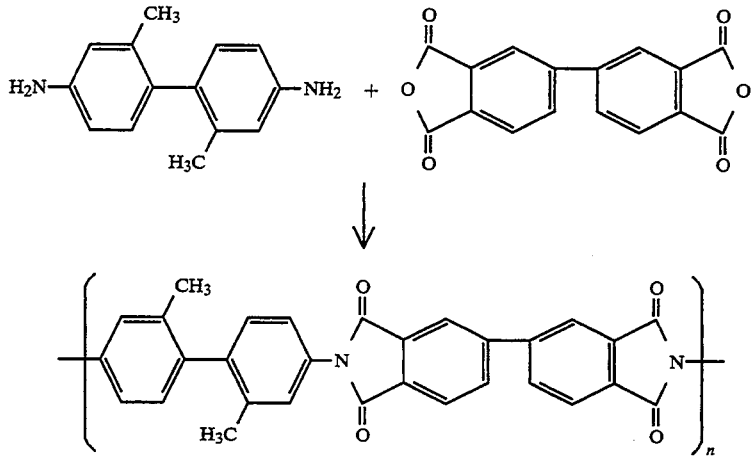

Crystalline structures formed at high temperature from the polyimides show wide-angle x-ray defraction patterns as well as birefringence. The structures are capable of superior crystalline packing characteristics and have a microfabril morphology. The crystal morphology as well as the polymer's relaxation processes favor superior compressive strengths, as will be referred to in the following. While the fibers do not have unusual tenacities and moduli as-spun, they can be highly drawn due to their unusual crystallization characteristics, after which they show excellent mechanical properties along with outstanding thermal and thermal-oxidative stability.

The polyimides of the invention are prepared, for example, by polymerizing 2,2'-dimethyl-4,4'-diaminobiphenyl, with a dianhydride in the presence of a suitable catalyst, and at an appropriate reaction temperature for a time sufficient to produce the desired polymer.

While the use of DMB is essential to the purposes of the invention, minor amounts of other diamines, for example, 1,4-phenylenediamine and 3,3'-dimethyl-4,4'-diaminobiphenyl can also be employed as co-reactants if desired. When such substitutions are made, however, the co-reactant should not exceed more than about 50 mole percent, based on the total moles of diamine present if the superior mechanical properties of the fibers are to be maintained.

While it has been found important to employ 2,2'-dimethyl-4,4'-diaminobiphenyl as a principal diamine, a number of dianhydrides may be used to prepare a polyimide suitable for purposes of the invention. In this regard, for example, the dianhydride may consist of 3,3',4,4'-biphenyltetracarboxylic dianhydride, BPDA. The substitution of pyromellitic dianhydride, PMDA, for a portion of the BPDA has been found to provide polyimides approaching equivalency to copolymers of DMB prepared with BPDA alone, but at a lower cost.

In preparing polymers of the invention from BPDA and DMB, the two monomers are added to the reaction mixture in about equal molar amounts. In those instances where PMDA is substituted for a portion of the BPDA, it has been found desirable to replace no more than about 50 percent of the BPDA with PMDA, on a molar basis, in order to avoid problems associated with insolubility in the reaction mixture.

In order to carry out the polymerization within a reasonable period, it has been determined to be preferable to conduct the reaction in the presence of a suitable catalyst, although none is required. Such catalyst may comprise an amine, for example, isoquinoline, or a carboxylic acid such as, for instance, formic acid, acetic acid, benzoic acid, and various substituted derivatives thereof.

The polymerization is conducted by combining the monomers and catalyst in a solvent capable of solubilizing the same, and heating the reaction mixture to its reaction temperature for a time sufficient to procure the desired reaction.

As will be apparent from the following, it has been determined that 2,2'-dimethyl-4,4'-diaminobiphenyl provides copolymers with properties clearly superior even to polyimides prepared from closely related diaminobiphenyls. However, it has also been determined that the use of the 2,2'-dimethyl substituents creates significant solubility problems. In this regard, a suitable solvent must be capable of solubilizing polyimides with molecular weights sufficient to provide the polymer physical properties desired. In the event that a proposed solvent is unable to do this, preparation of the polymer in a single step becomes impractical if not impossible.

In the case of the polymers contemplated by the invention disclosed herein, it has been found that p-chlorophenol is uniquely capable of providing the solubilizing action necessary for the polymerization reaction. This solvent specificity is particularly surprising in light of the fact that the polymer formed from 2,2'-bis(-trifluoromethyl)-4,4'-diaminobiphenyl with BPDA shows good solubility in m-cresol, but only limited solubility in halogenated hydrocarbon solvents. The fact that the polyimide prepared from DMB and BPDA, although insoluble in other organic solvents can be solubilized in p-chlorophenol is fundamental to the discovery that the DMB-containing copolymers of the invention can be successfully prepared with the one-step process. Furthermore and importantly, copolymers can be prepared by the process of the invention with molecular weights high enough to yield viscositites in the range of at least about 5 to about 10 dL/g.

Following preparation of a reaction mixture as described, the mixture is heated to the reflux temperature of the p-chlorophenol, i.e., to about 220° C., and such reaction condition is maintained for a time long enough to produce the degree of polymerization desired, normally a period of from about 4 to 12 hours. The amount of p-chlorophenol required to carry out the polymerization reaction will vary depending upon the nature and amounts of reactants present, and is determined by the amount of solvent sufficient to maintain the components of the reaction and the copolymer product produced in solution. However, the use of an amount of solvent sufficient to provide a solids content of up to about 20 percent by weight is typically employed.

Following preparation of the polymer in the p-chlorophenol solution as described, fibers may be spun directly therefrom. Spinning may be accomplished either from an isotropic solution of the copolymer, or from the copolymer solution in its gel state. Commonly, resort will be had to a dry jet-wet spinning method in which the fiber is forced from a spinnerette into air, and substantially immediately thereafter passed into a non-solvent bath where fiber coagulation and solvent extraction take place. In the case of isotropic spinning, hot solutions of the fiber, for example, those heated to above about 140° C., at a solids concentration of up to about 15 percent by weight, are forced from the spinnerette and thereafter received in a coagulation bath.

Alternatively, however, the solutions of the polymer can be cooled below their gelation temperature, for example, to from about 80° to about 90° C., at which point the gel formed is forced through the spinnerette into the coagulation bath. Of the methods described, gel spinning is sometimes preferred since the fibers produced tend to maintain their continuity and resist fragmentation. In addition, gel-spun fibers are less likely to form solvent-trapping outer skins that result in microvoid-containing fibers, which is commonly the result of using an isotropic spinning process.

FIG. 1 shows a schematic representation of a dry jet-wet spinning fiber formation process, generally 10. As shown, the process comprises the use of a spinning head 12 in which the solution of copolymer in p-chlorophenol is maintained under a nitrogen atmosphere introduced at inlet 14. The solution is forced through a spinnerette 16 into a coagulation tube 18 filled with a non-solvent for the polymer such as an alcohol or acetone mixed with water, which is recirculated through line 20 by means of a pump 22. The coagulated fiber proceeds to a receiving roll 24, and from where it is directed to a return roll 26, being wrapped in loops around the two rolls so that the fiber is passed back-and-forth a number of times between the return roll and the receiving roll through the coagulation fluid 28 maintained in coagulation tank 30. Following completion of coagulation, the as-spun fiber 32 is taken up on wind-up roll 34.

Typically the intrinsic viscosity of the polyimides will be from about 5 to about 10 deciliters per gram at 60° C. while the concentration of the polymer in the spinning solution will preferably range from about 6 to about 10 percent, by weight. During the spinning process, the solution is ordinarily degassed and filtered before being extruded through the spinnerette into the coagulation bath, which frequently contains an aqueous ethanol or acetone solution containing from about 50 to about 95 percent by weight ethanol or acetone. Although different speeds may be employed, it has been found that a spinning speed of about 1 to about 60 meters per minute provides satisfactory results insofar as fiber formation is concerned. If desired, and following the formation of the fibers as described in the preceding, the fibers can be further washed in a refluxing ethanol or acetone bath for an additional 2 to 5 hours, the time being dependant upon the washing temperature. Fibers thus processed may then be step-dried in an oven at about 50° to about 80° C. for 2 to 3 hours, prior to being drawn.

Whether spun from isotropic solution, or from a gel state, the spinning process described provides a fiber with properties superior to those spun from lyotropic liquid crystalline polymers. As previously indicated, while fibers of the invention do not display exceptional amounts of crystallinity or orientation in their as-spun condition, they can be drawn and annealed subsequent to their formation in a way that achieves high degrees of both crystallinity and crystal orientation.

In the foregoing regard, a notable and unexpected characteristic of the polyimides taught herein is that they crystallize at a relatively slow rate compared, for example, with the polyimides prepared from 3,3'-dimethyl-4,4'-diaminobiphenyl. This slow rate of crystallization allows their fibers to be easily drawn to high draw ratios. In addition, the crystal habit of the polyimides of the invention in which the methyl substituents in the diamine component are located in the 2 and 2' positions is such that it results in the formation of triclinic crystals, i.e., crystals of low-symmetry. In contrast in similar polyimides when the methyl groups are substituted in the 3 and 3' positions, orthorhombic crystals are formed, or in similar polyimides when fluorinated methyl groups are located in the 2 and 2' positions, such as those prepared from 2,2'-bis(trifluoromethyl)-4,4'-diaminobiphenyl, FMB, monoclinic crystals are formed. Consequently, both the nature of, and the position of the substituent have been found to be important relative to drawing the polyimide fibers, and therefore to the physical properties of the finished fibers.

In the case of the methyl group, the substituent group of the polyimides of the invention, the substituent group is smaller than, for example, a fluorine-substituted methyl substituent group; consequently, a higher crystalline content can be developed with the methyl substituent groups of the invention during the drawing process. In addition, and as previously stated, the fact that the methyl groups are substituted in the 2 and 2' positions of the diamine results in polyimides that slowly crystallize so that greater drawing ratios can be achieved compared with, for example, polyimides prepared from diamines with methyl groups substituted in the 3 and 3' position.

The foregoing is of importance to the physical modifications effected during the drawing process, in which the orientation and crystallinity responsible for the desirable physical characteristics of the fiber are developed. In this regard, it is essential that the maximum crystallinity and crystal orientation can be achieved during the drawing and annealing processes in order to optimize the mechanical properties. Therefore, the control of crystallization kinetics is extremely important. When the crystallization is too fast, the fibers cannot be drawn to a high ratio, thus, better tensile properties are not obtained due to a lack of high crystal orientation.

Polyimide fibers of the invention are typically drawn and annealed at temperatures higher than their glass transition temperature, that is, usually between about 400° and 450° C. Draw ratios up to about 10:1, i.e., 1000 percent, are readily achieved with the fibers.

Such highly drawn fibers are characterized by birefringence values of above 0.6, crystal orientations of over 0.9, and crystallinities exceeding 60 percent. Such characteristics lead to tensile strengths of higher than about 26 gpd, tensile moduli of over 1300 gpd, and elongation-to-break values of about 2 percent. The fibers exhibit excellent thermo-oxidative stability compared with other high-performance organic fibers, and they retain about 80 percent of their tensile modulus at 400° C. for at least about 3 hours of continuous use.

Figure 2:
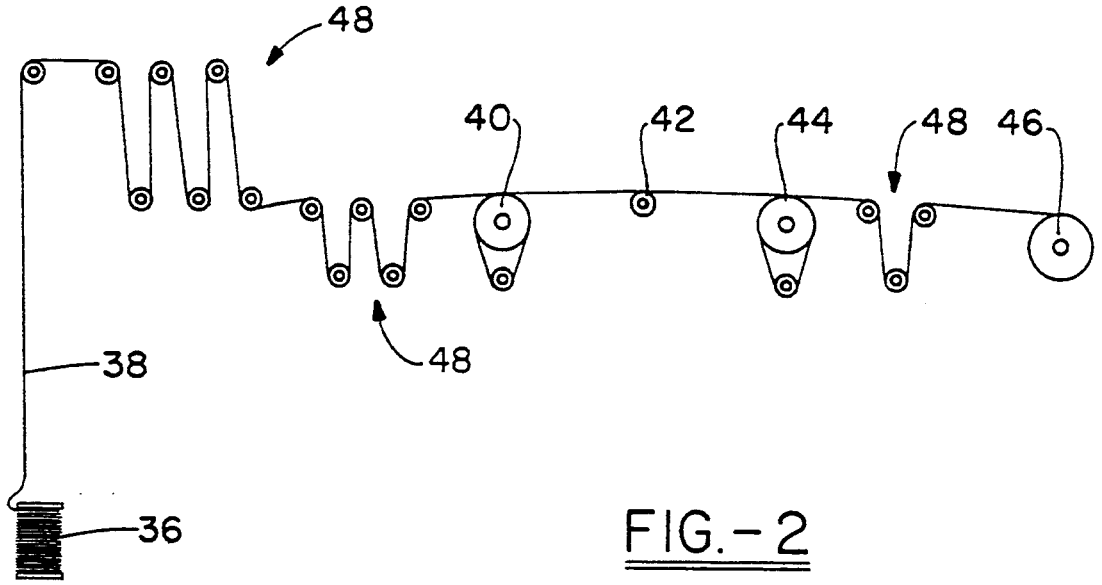
FIG. 2 is a schematic representation of a fiber drawing process.

FIG. 2 is a schematic representation of a fiber drawing process which simultaneously accomplishes an annealing heat treatment of the fibers under tension, as well as their drawing. From a molecular point of view, both the annealing and drawing affect chain orientation, crystallinity, crystal size, and the morphology of the fibers generally.

The Figure shows a drawing apparatus for fibers of the invention comprising a feed bobbin 36 from which the fiber to be drawn 38 is fed over a series of tensioning rolls 48 to a draw roll assembly 40. From the assembly 40, the fiber proceeds over an annealing heater 42 before encountering draw roll assembly 44 which runs faster than assembly 40, thereby stretching or drawing the fiber. From draw roll assembly 44, the drawn fiber proceeds over a series of tensioning rolls 48 to wind-up roll 46 on which the drawn fiber is collected. Other methods of drawing and annealing the fibers of the invention which are well known by those skilled in the art may also be used.

While some applications demand certain minimum tensile moduli and tensile strengths, many of them also require that the fibers resist transverse forces, particularly those resulting from bending. It has been found that polyimides of the type with which the invention is concerned have compressive mechanical properties of a high order relative to ordinary high-performance organic fibers. In this connection, the fibers of the invention show compressive strengths ranging from 600 to 800 MPa, a range 50 to 100 percent greater than commercial organic fibers.

Further confirmation of the important differences which the nature of the substituent employed has on the physical properties of the fibers of the invention is evidenced by the following table of data.

| Property | BPDA/FMB | BPDA/DMB |
|---|---|---|
| Spinning Method | Dry Jet-Wet Spun | Dry Jet-Wet Spun |
| Draw Ratio | 10x | 10x |
| Tensile Strength (room temp.) | 24 g/d | 26 g/d |
| Tensile Modulus (room temp.) | 1000 g/d | 1300 g/d |
| Compressive Strength (room temp.) | 450 MPa | 650 MPa |
| Crystallinity | 50% | 65% |
| Overall Orientation | 85% | 85% |
| Thermal Stability (5% Wt. Loss in Air) | 600° C. | 500° C. |
| Crystal Structure | Monoclinic | Triclinic |
| Density | 1.401.5 g/cm$^3$ | 1.3–1.45 g/cm$^3$ |

-continued

| Property | BPDA/FMB | BPDA/DMB |
|---|---|---|
| Tg | ~290° C. | ~300° C. |

With respect to the importance of substituent position, it has been found that the polyimides prepared from 3,3'-dimethyl-4,4'-diaminobiphenyl of the prior art, in addition to showing different physical characteristics, also display dissimilar chemical behavior as is demonstrated by the fact that they are less resistant to chemical bases than the polyimides of the invention.

While not intended to be limiting in nature, the following examples are illustrative of the invention.

EXAMPLE 1

Synthesis of 2,2'-dimethyl-4,4'-diaminobiphenyl (DMB)

A mixture of 40.0 grams, 0.30 moles, of m-nitrotoluene; 24 mL of a 20 percent aqueous solution of sodium hydroxide, and 120 mL ethanol is stirred and heated at gentle reflux. Zinc dust, 69.6 grams, is slowly added to keep the solution boiling without heating. Following addition of the zinc dust, the mixture is heated at reflux for about 4 hours. The hot mixture is filtered by suction, and the zinc residue is washed with ethanol. Concentrated hydrochloric acid is then slowly added to the filtrate. The precipitate formed is collected following filtration and redissolved in hot water. The aqueous solution is thereafter allowed to cool to room temperature and basified with a 20 percent aqueous solution of sodium hydroxide. The resulting DMB is an oil that is extracted with ethyl ether following its formation. Subsequent evaporation of the ethyl ether yields an oil containing 18.3 grams, 57.4 percent, of solids following cooling. Finally, the solid DMB is recrystallized from ethyl ether.

Synthesis of Polyimide with One-Step Polycondensation Procedure 3,3',4,4'-Biphenyltetracarboxylic dianhydride obtained from Chriskev Chemical Co., 0.0142 moles, is added to a stirred solution of 0.0142 moles of DMB prepared according to the preceding procedure in a solubilizing amount of p-chlorophenol containing an isoquinoline polymerization catalyst. The additions are made under a nitrogen blanket at room temperature. The reaction mixture thus prepared is then heated to 216° C. and maintained at that temperature for approximately 4 hours. During the reaction period, the water of imidization is allowed to distill from the reaction mixture, together with 2.5 mL of p-chlorophenol. The p-chlorophenol is continually replaced, however, in order to keep the total volume of the solution constant. At the conclusion of the reaction, the solution is diluted to a solids content of about 8 percent, by weight. Fibers are spun from the solution directly, as previously described.

EXAMPLE 2

In a further experiment, a mixture of DMB and a second diamine, i.e., p-phenylenediamine, PPD, is reacted with BPDA. In the experiment, 3.40 m moles of BPDA are added to a stirred solution of 1.70 m moles of DMB in p-chlorophenol to produce a solution of the reactants. A catalytic amount of isoquinoline is then added under nitrogen at room temperature to initiate the reaction. As the reaction progresses, the water of imidization is allowed to distill from the reaction mixture. After the reaction mixture has cooled to ambient temperature, 1.70 m mole of PPD are added to the solution, which is then heated to about 214° C. and maintained at that temperature for about 12 hours. The copolymer-containing solution is subsequently diluted and precipitated in ethanol, following which the precipitate is collected by filtration and dried under vacuum at 200° C. for approximately 24 hours to produce the desired copolymer.

EXAMPLE 3

In a still further experiment, two diamines are polymerized with two dianhydrides as follows. 2.36 m moles of BPDA and 0.124 m mole of 3,3',4,4'-benzophenonetetracarboxylic dianhydride, BTDA, are added to a stirred solution of 2.36 m mole of DMB, and 0.124 m mole of 1,3-bis[4-(4-aminophenoxy)benzoyl] benzene, BABB, the reactants being dissolved in a solvating amount of p-chlorophenol containing an isoquinoline catalyst. The procedure is carried out under a nitrogen atmosphere at ambient temperature. The solution is thereafter heated to 220° C. and maintained at that temperature for about 5 hours. During this time, the water of imidization is allowed to distill from the reaction mixture, together with 0.2 mL of p-chlorophenol. The p-chlorophenol is continually replaced in order to keep the total volume of the solution constant. Fibers are subsequently directly spun from the solution as previously described.

EXAMPLE 4

In yet another experiment, DMB is copolymerized with PDA and PMDA in the molar ratio of 10/7/3. In the experiment, 3.30 m moles of BPDA and 1.41 m moles of PMDA are added to a stirred solution of 4.71 m moles of DMB in a solvating amount of p-chlorophenol containing a catalytic amount of isoquinoline. The procedure is conducted under nitrogen at ambient temperature. The solution is then heated to 214° C. and maintained at that temperature for two hours. During such time, the water of imidization is allowed to distill from the reaction mixture, together with 0.7 mL of p-chlorophenol. The p-chlorophenol is continually replaced in order to keep the total volume of the solution constant. The solution is subsequently diluted to approximately 8 percent by weight and maintained at 214° C. for approximately two hours. The copolymer solution is thereafter used to spin fibers.

EXAMPLE 5

In an experiment designed to determine solubility of the polyimide fibers of the invention, the as-spun fibers prepared from DMB and BPDA are placed in 5 separate bottles, the first containing m-cresol, the second 2,4-dichlorophenol, the third p-nitrophenol, the fourth m-nitrophenol, and the fifth p-chlorophenol. Sufficient amounts of the respective solvents are added to bring the concentration of solids in each of the bottles to about 10 percent by weight. The mixtures are then heated to 120° C.; however, with the exception of the fibers in p-chlorophenol, which dissolve in the solvent, the fibers in the other bottles are either insoluble or only slightly soluble therein. Repeating the experiment in which, however, the solids content is adjusted to about 5 percent, the result remains substantially unchanged.

EXAMPLE 6

In an additional experiment, DMB and BPDA are reacted in a variety of solvents according to the polymerization procedures previously described, with the following results.

| Run No. | Molar Ratio of Monomers DMB | BPDA | Monomer Conc. Wt. % | Solvent | Intrinsic Viscosity dL/g in p-chlorophenol at 50° C. |
|---|---|---|---|---|---|
| PIM-01 | 1 | 1 | 10 | m-cresol | ppt.* |
| PIM-02 | 1 | 1 | 10 | p-chlorophenol | 3.64 |
| PIM-03 | 1 | 1 | 10 | p-chlorophenol | 8.63 |
| PIM-04 | 1 | 1 | 10 | p-chlorophenol | 11.0 |
| PIM-09 | 1 | 1 | 10 | 2,4-dichlorophenol | ppt.* |
| PIM-10 | 1 | 1 | 10 | o-chlorophenol | ppt.* |
| PIM-11 | 1 | 1 | 10 | o-chlorophenol | ppt.* |

*Procedure becomes impractical

The results confirm the unique solvency of p-chlorophenol with respect to the polyimide polymers of the invention.

EXAMPLE 7

DMB, BPDA and OTOL are copolymerized in the molar ratio 5/10/5 as follows. BPDA, 4.71 mmol, is added under nitrogen at ambient temperature to a stirred solution of 2.36 mmol of DMB and 2.36 mmol of OTOL in an appropriate amount of p-chlorophenol containing a catalytic amount of isoquinoline. The solution is heated to 220° C. and maintained at that temperature for about 3 hours. During this time, the water of imidization is allowed to distill from the reaction mixture. A viscous polymer is thus obtained. The polymer solution is then diluted to 8 percent by weight and stirred at 220° C. for 2 hours. Fibers subsequently prepared from the copolymer are found to have a tensile strength of about 20 g/den.

While particularly useful in forming fibers, the polyimide polymers of the invention can also be used to form composite structures possessing excellent physical properties.

While in accordance with the Patent Statutes, a preferred embodiment and best mode has been presented, the scope of the invention is not limited thereto, but rather is measured by the scope of the attached claims.

What is claimed is:

1. A process for preparing a segmented rigid-rod polymer fiber comprising:

combining reactants which include 2,2'-dimethyl-4,4'-diaminobiphenyl and a tetracarboxcylic dianhydride in p-chlorophenol to form a liquid reaction mixture, heating said reaction mixture until said reactants have polymerized to form a segmented rigid rod polymer, forming a fiber from said polymer, and drawing said fiber from about 800 to about 1,000 percent of its initial length at a temperature from about 400° to about 450° C. following its fabrication.

2. A process for preparing a polyimide fiber comprising combining reactants which include 2,2'-dimethyl-4,4'-diminobiphenyl and a tetracarboxylic dianhydride in p-chlorophenol to form a liquid reaction mixture;

heating said reaction mixture until said reactants have polymerized to form a copolymer;

forming a fiber with said copolymer directly from said reaction mixture; and drawing said fiber from about 800 to about 1,000 percent of its original length at a temperature of from about 400° to 450° C. to form a polyimide fiber.

3. A process according to claim 2, in which said reaction mixture contains a polymerization catalyst.

4. A process according to claim 2, in which said tetracarboxylic dianhydride contains at least about 50 mole percent of 3,3'4,4'-biphenyltetracarboxylic dianhydride, the balance of said dianhydride being promellitic dianhydride.

* * * * *